United States Patent [19]

Corey

[11] 4,086,111

[45] Apr. 25, 1978

[54] WOOD SPLITTER

[76] Inventor: Max L. Corey, P.O. Box 384, Silverdale, Wash. 98383

[21] Appl. No.: 722,383

[22] Filed: Sep. 13, 1976

[51] Int. Cl.[2] ..... B27L 7/00

[52] U.S. Cl. ..... 144/193 A; 83/623; 125/23 R; 144/3 K; 144/193 F; 144/193 K

[58] Field of Search ..... 144/193 R, 193 A, 3 K, 144/193 K, 194, 193 F; 125/23 R, 23 C; 225/103; 83/623

[56] References Cited

U.S. PATENT DOCUMENTS

| | | | |
|---|---|---|---|
| 873,418 | 12/1907 | Eckenroth, Jr. | 144/193 A |
| 2,851,072 | 9/1958 | Gerjets et al. | 144/193 A |
| 3,077,214 | 2/1963 | Brukner | 144/193 A |
| 3,137,191 | 6/1964 | O'Brien | 83/623 X |
| 3,356,115 | 12/1967 | Cole | 144/193 R |
| 3,424,144 | 1/1969 | Giconi | 125/23 R |
| 3,727,600 | 4/1973 | Schlough | 125/23 C |
| 3,760,854 | 9/1973 | Worthington | 144/193 A |
| 3,779,295 | 12/1973 | Balsbaugh | 144/193 A |

*Primary Examiner*—Othell M. Simpson
*Assistant Examiner*—W. D. Bray
*Attorney, Agent, or Firm*—David Harry Deits; Roy E. Mattern, Jr.; Kenneth S. Kessler

[57] ABSTRACT

A wood splitter, particularly suited to hydraulic operation, for mechanically splitting sections of wood lengthwise for shakes or for more suitable sizes for burning is provided. In a preferred form the device is mounted on a trailer having a flat working deck. A column, which is lowerable for travel, projects upward out of the deck. A lever arm actuated by a hydraulic cylinder is attached to the column below the deck and upon actuation of the cylinder projects upward through a hole in the deck. A splitting blade is slidably mounted on the column over the lever arm. A piece of wood is placed over the lever arm and the blade which is also actuated by a hydraulic cylinder is lowered, by operation of a foot lever, against the top of the piece of wood. The contact with the wood is sensed by a sequence valve which then causes the lever arm to raise above the deck forcing the wood to be split by the blade. If the wood does not split cleanly the blade automatically lowers more closely toward the lever which retracts then actuates again. Another embodiment of the wood splitter utilizes the blade mounted on a threaded screw. The screw is rotated to raise or lower the blade rather than a cylinder.

18 Claims, 10 Drawing Figures

WOOD SPLITTER

BACKGROUND OF THE INVENTION

1. Field of the Invention

The invention relates to a wood splitter particularly suited to longitudinally severing lengths of logs into section more suitable and conducive to fireplace use or for splitting shakes. The task of splitting precut log sections into longitudinal segments if done by hand with an ax or hammer and wedge is a tiresome, arduous task, particularly if large numbers of logs must be split.

2. Prior Art

Mechanical splitters have been devised to reduce the amount of manual labor necessary to accomplish the task and increase productivity. U.S. Pat. Nos. 3,760,854, Worthington; No. 3,356,115, Cole; and No. 3,077,214, Brukner are illustrative of such devices. In each disclosed device an actuator, such as a hydraulic cylinder, mounted on a base, expands linearly to force a log laying on the base against a blade rising above the base opposite the log from the actuator causing the log to split. A related device is disclosed in U.S. Pat. No. 3,721,281, Bartlett. It discloses a pair of blades dependent from a beam normally suspended above the object to be split, such as a tree stump. Actuators, such as hydraulic cylinders, depend from either end of the beam and forcefully move the lower ends of two blades dependent from the beam at their upper ends toward each other severing the stump in between the blades.

Typical mechanical wood splitters dump the pieces on the ground where they must be retrieved. Coupled with the usual necessity of bending over and picking up the whole sections of wood to load into the splitter, the machine operator is required to make many, tiresome lifting and bending motions.

Most mechanisms have the log or wood section lying on its side during the splitting operation. The wood is generally more difficult to turn and position for another split when on its side. Also there is generally little control of the position of the wood during splitting.

Most wood splitters split from one side of the wood, having a fused member on the opposite side of the wood from the blade. This type of operation tends to be slow.

The disclosed splitter avoids the above problems and is additionally usable to split shakes in addition to firewood.

SUMMARY OF THE INVENTION

A wood splitter, particularly suited to hydraulic operation, for mechanically splitting sections of wood lengthwise for shakes or for more suitable sizes for burning is provided.

In its preferred form the wood splitter is mounted on a trailer structure for portability. The trailer has a planar working deck on which the splitting is done. This avoids the requirement that the operator bend over to manipulate logs in the splitter or retrieve the pieces that are split. A column is positioned in an upright position on the deck. The column is capable of being lowered for travel. A wedge shaped blade with its edge directed downward toward the deck is slidably attached to the column on tracks. A lever arm is attached to the lower end of the column. The lever arm is actuated by a hydraulic cylinder. Extending the cylinder causes an end of this lever, or log lifter, to extend upward through an opening in the deck toward the blade. Another hydraulic cylinder is attached to the column and the blade to raise and lower the blade. A hydraulic pump driven by a gasoline engine supplies hydraulic fluid under pressure to operate the splitter. A control valve having three control positions is operated from a foot lever on the rear of the trailer. The three positions correspond to a cylinder extension position to lower the blade and raise the lever; a neutral position to hold the position of the blade and lever; and a cylinder retraction position to raise the blade and lower the lever. The foot lever is spring loaded to stay normally in the cylinder retraction position. A sequence valve is provided in the hydraulic control system to activate the lift cylinder only after a certain pressure level in the hydraulic fluid is reached. A holding valve is also provided to prevent the lifter cylinder, which is normally larger, from overpowering the blade cylinder during splitting.

In operation, a log is placed upright over the log lifter and the blade lowered by operating the foot lever. When the blade encounters the top of a log it raises the hydraulic fluid pressure. This actuates the sequence valve and causes the log to be pushed against the blade by the log lifter and to be split. The blade is prevented from retreating under the upward force by the holding valve and the tendency of the blade to bind upon the tracks.

Another embodiment of the wood splitter utilizes a rotating threaded shaft passing through a threaded hole in the blade, rather than a cylinder, to raise and lower the blade.

One configuration of the blade has a thickness guide on one side so that shakes may be split with the apparatus. The guide is held in position by a magnet. The guide swings out of the way to allow the split off shake to pass once the split is made.

DETAILED DESCRIPTION OF THE INVENTION

Introduction

It is generally an arduous and time consuming task to split wood by hand, i.e., with an ax or hammer and wedge. This splitting is most often done either to reduce log sections to a convenient size for fireplace burning or to make shakes for roofing or siding from blots of cedar or other wood. A wood splitter 20 is provided for performing both types of wood splitting tasks with considerably less effort and more speed than hand splitting.

Preferred Embodiment

Figure 1:
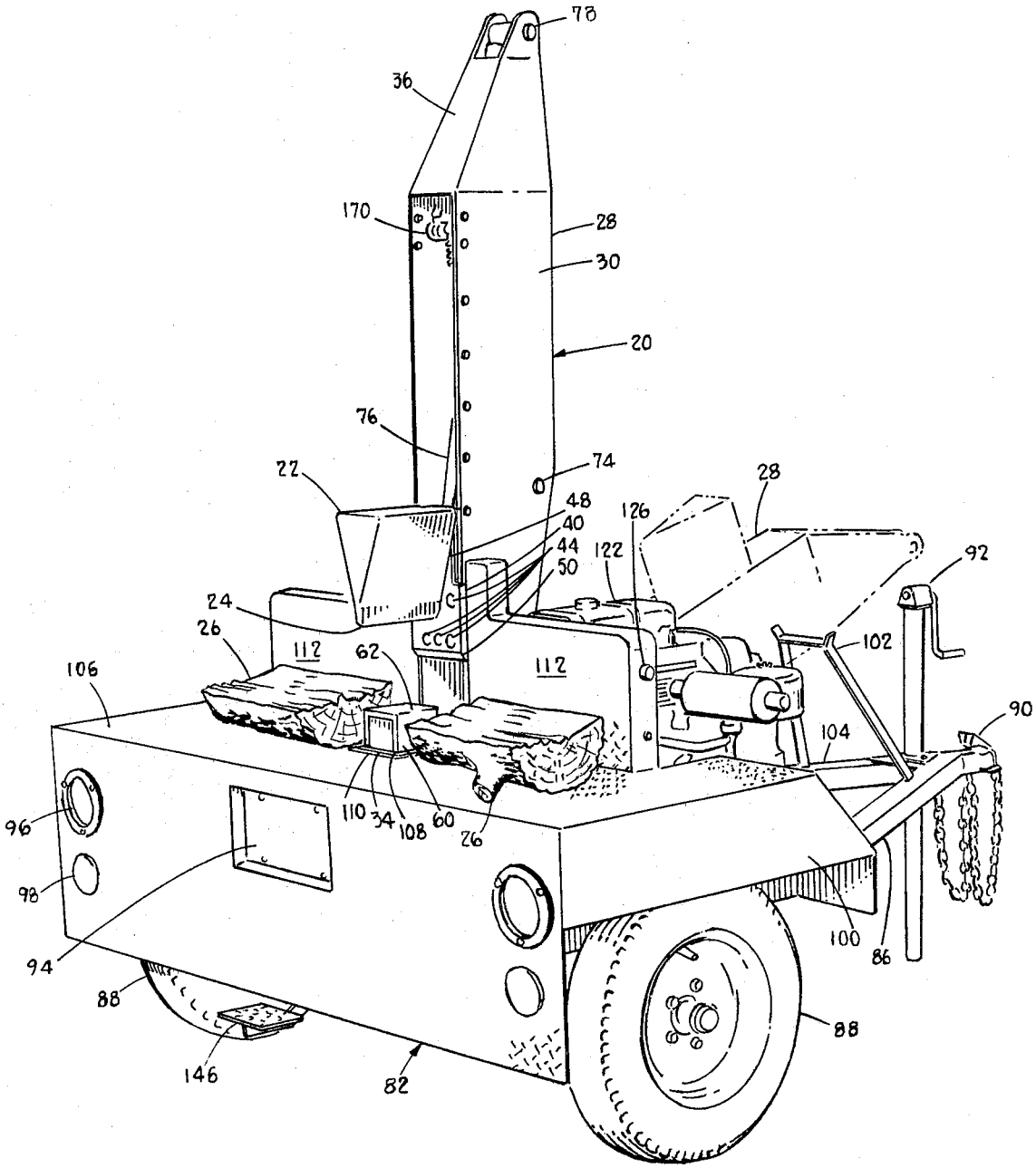
FIG. 1 is a perspective view of the preferred embodiment of the wood splitter.
Figure 2:
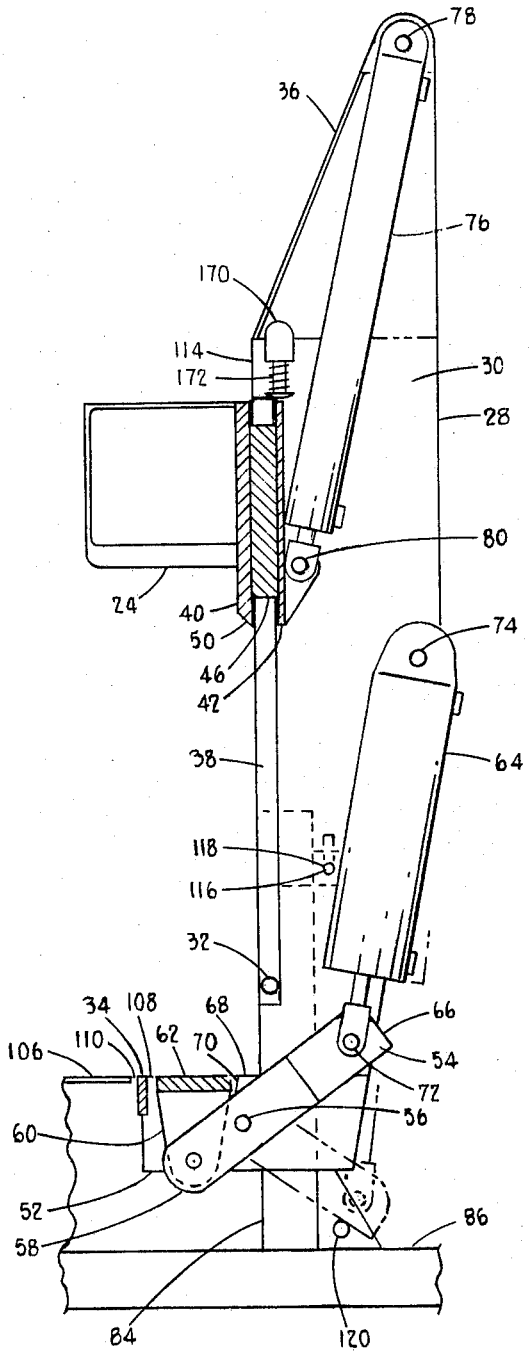
FIG. 2 is a partial side elevation of the preferred embodiment of the wood splitter, in section, illustrating the splitting mechanism.
Figure 3:
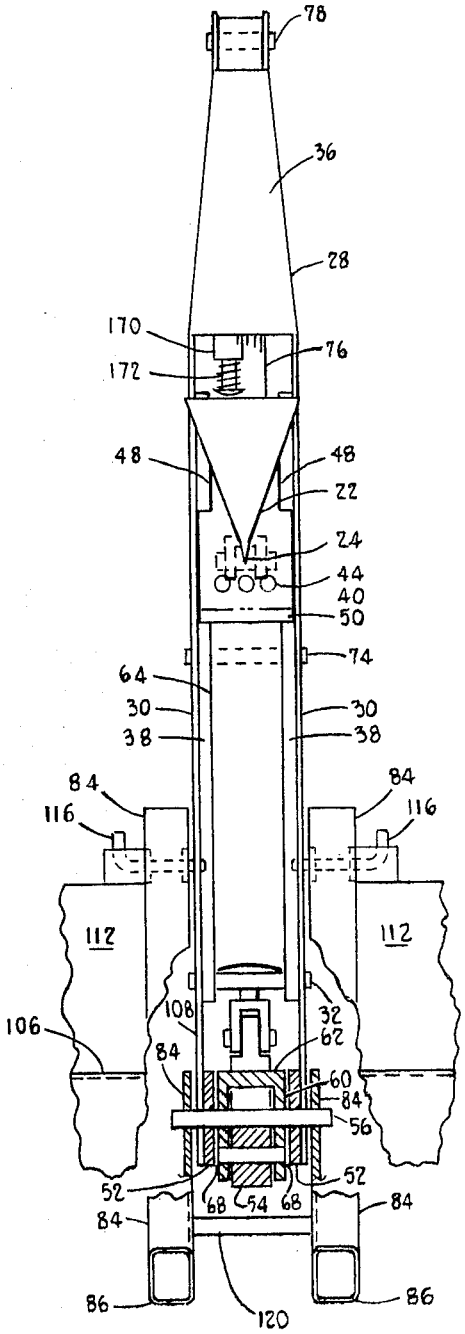
FIG. 3 is a partial elevation of the preferred embodiment of the wood splitter illustrating the splitting mechanism shown in FIG. 2 viewed from the front of the column.

Referring to FIGS. 1, 2, 3, 4, 5 and 8, which illustrate the preferred embodiment adapted for splitting firewood, the wood splitter 20 is provided with a splitting blade 22. The blade 22 is generally triangular in cross-section, as shown in FIG. 3, with an edge 24 which contacts the wood 26, shown just after splitting in FIG. 1. The blade 22 is preferably made of steel and has the edge 24 sharpened.

The blade is attached to a supporting column 28 which is upright during the splitting operation. In its preferred form, the column is hollow, having side members 30, spacer bars 32, and spacer members 34 and 36. Elongated rectangular tracks 38, preferably of hard steel, are mounted on opposite interior surfaces of the side member 30. The blade 22 travels along these tracks 38. The blade is attached to the tracks by the use of three plates. A front support plate 40 and a rear support plate 42 wider than the distance between the tracks 38 are secured together by screws 44 having their heads counter sunk below the surface of the front support plate 40. A spacer plate 46 narrower than the distance between the tracks and slightly thicker than the width of the track 38 is sandwiched between the front and rear support plates 40 and 42 and held in position by the screws 44. This forms elongated grooves which engage the track 38 and secure the blade, which is attached to the front support plate, to the column 28. The front support plate 40 has its upper edges 48 on both sides cut away so that in this upper portion it is narrower than the distance between the tracks 38. This permits the blade assembly to rotate slightly clockwise as viewed from the side as in FIG. 2 with the upper edges 48 of the front support plate passing between the tracks 38. The lower end 50 of the front support plate 40 is beveled to keep the end from hanging up on its downward travel on the edge of a log placed under the blade 22. The column 28 has side sections 52 which project under the blade 22 at the lower end of the column. These side sections 52 have spacer members 34 across their outside ends to form an enclosing box-like structure at the base of the column.

A pusher member in the form of a lever arm 54 is located within the box-like structure at the base of the column 28. It is pivotally mounted on a pin 56 through a point intermediate to its ends. One end 58 is opposite the blade edge 24 and has a log lifter bracket 60 pivotally attached to it. The top surface 62 of the log lifter bracket 60 is maintained in a horizontal position when the lever moving mechanism, the hydraulic cylinder 64 attached to the other end 66 of the lever, is in the retracted position as shown in FIG. 2. It is maintained in this horizontal position by guide plates 68. The guide plates 68 are simply two small plates attached to opposite inner surfaces of the lower column side sections 52. The front edges of the guide plates 70 contact the rear edge of the log lifter bracket 60. The lever, or lifter, cylinder 64 is pivotally attached by pins 72 and 74 between the column 28 and the end 66 of the log lifter lever arm 54 and raises and lowers the log lifter bracket 60 between the raised or extended position shown in FIG. 1 and the lowered or retracted position shown in FIGS. 2 and 3. Another, but smaller diameter hydraulic cylinder 76 is attached by pins 78 and 80 between the column 28 and the rear blade support plate 42. This blade cylinder 76, shown in its retracted or raised position in FIGS. 2 and 3, serves as a blade moving mechanism and moves the blade 22 up and down the column 28. Its extended or lowered position is shown in FIG. 1 where its downward travel is limited by contact with spacer bar 32.

The column is pivotally mounted on a trailer structure 82 on pin 56 which is secured to vertical members 84 of the trailer framework. The trailer structure permits the wood splitting mechanism, which is principally the column and its associated hardware, to be easily towed to various work sites for convenient use wherever the wood is located. The trailer consists of a hollow, rectangular, horizontal framework 86 supported on wheels 88 having a conventional vehicle attachment mechanism 90. It also has an adjustable tongue support jack 92 as well as the typical provision for a license plate 94, tail lights 96, reflectors 98, and fenders 100 for highway travel. A cradle 102 is provided on the tongue section 104 of the horizontal framework 86 to receive the column when it is in its lowered position for travel, as shown in phantom in FIG. 1. The trailer has a substantially planar working deck 106 which is level with the top edge 108 of the box-like structure enclosing the lever arm 54 and lifter bracket 60 at the base of the column 28 which fit in an opening 110 in the deck surface. A pair of panels 112 are positioned vertically even with the front face 114 of the column 28. A spring loaded column locking pin 116 is attached to a vertical member 84 of the trailer framework. The locking pin 116 passes through a hole 118 in a side member 30 of the column 28 to secure the column in the upright position for the splitting operation. A cross bar 120 runs transversely beneath the cylinder end 66 of the lever arm 54. It is spaced below the lever arm so that when the lever arm is in the extended position with the column in the upright position, shown in phantom in FIG. 2, it narrowly misses contacting the bar 120.

Figure 4:
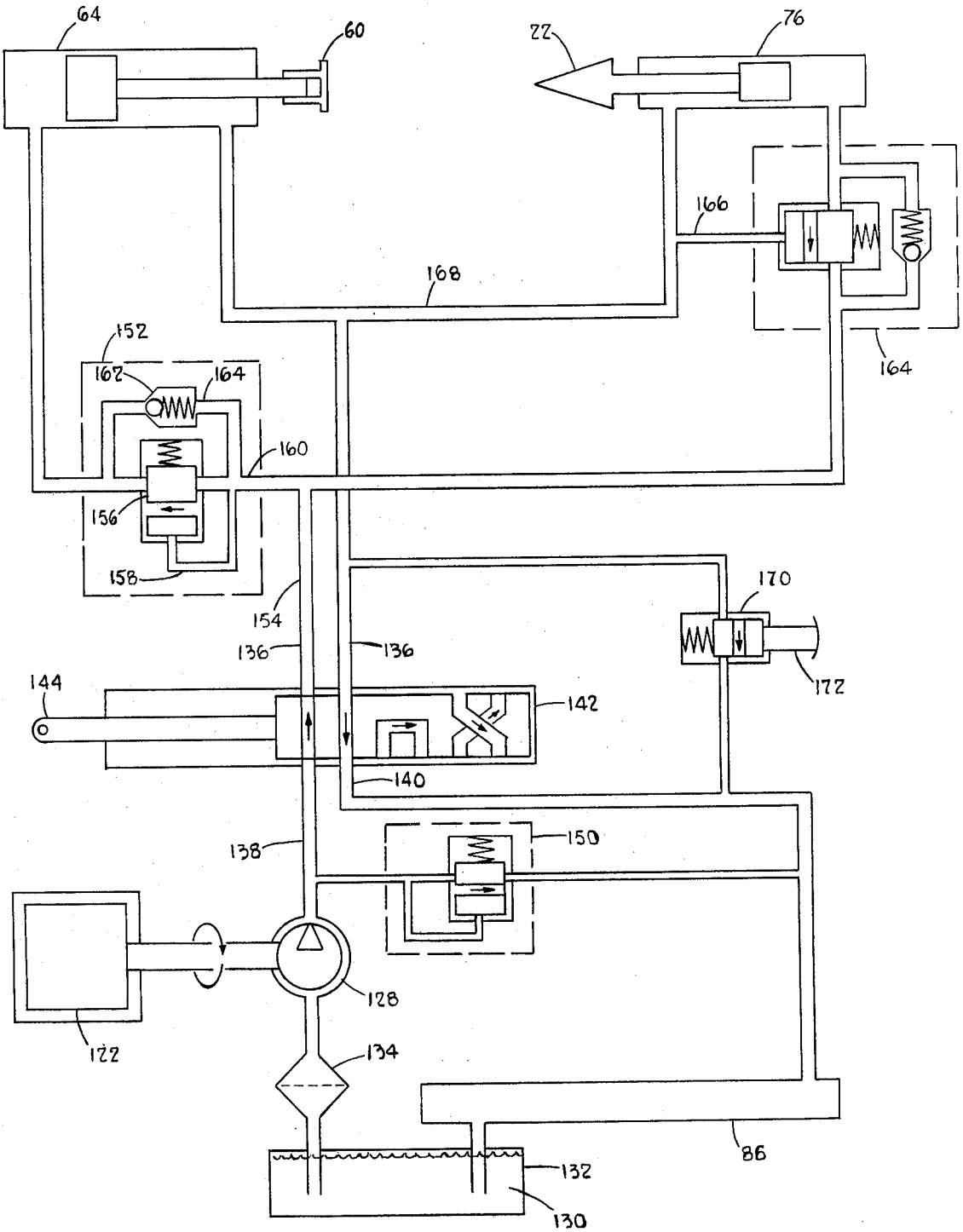
FIG. 4 is a schematic of the hydraulic system of the preferred embodiment.
Figure 5:
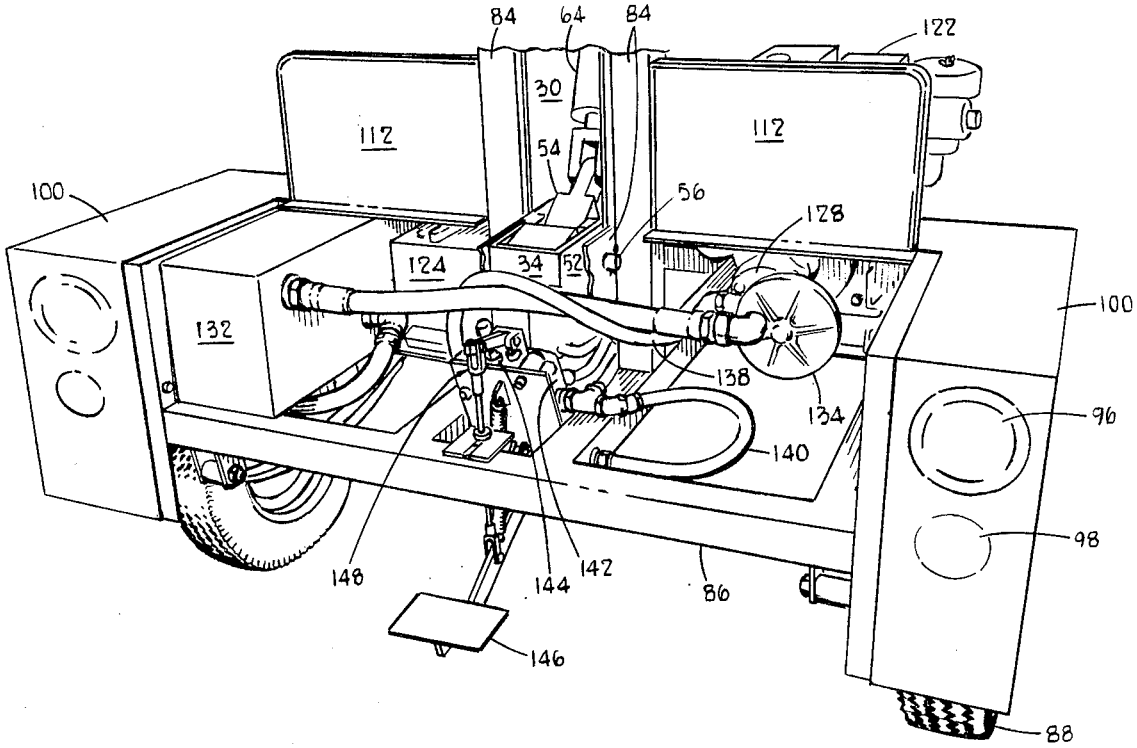
FIG. 5 is a perspective view of the preferred embodiment of the wood splitter with portions of the decking and rear panels removed.
Figure 8:
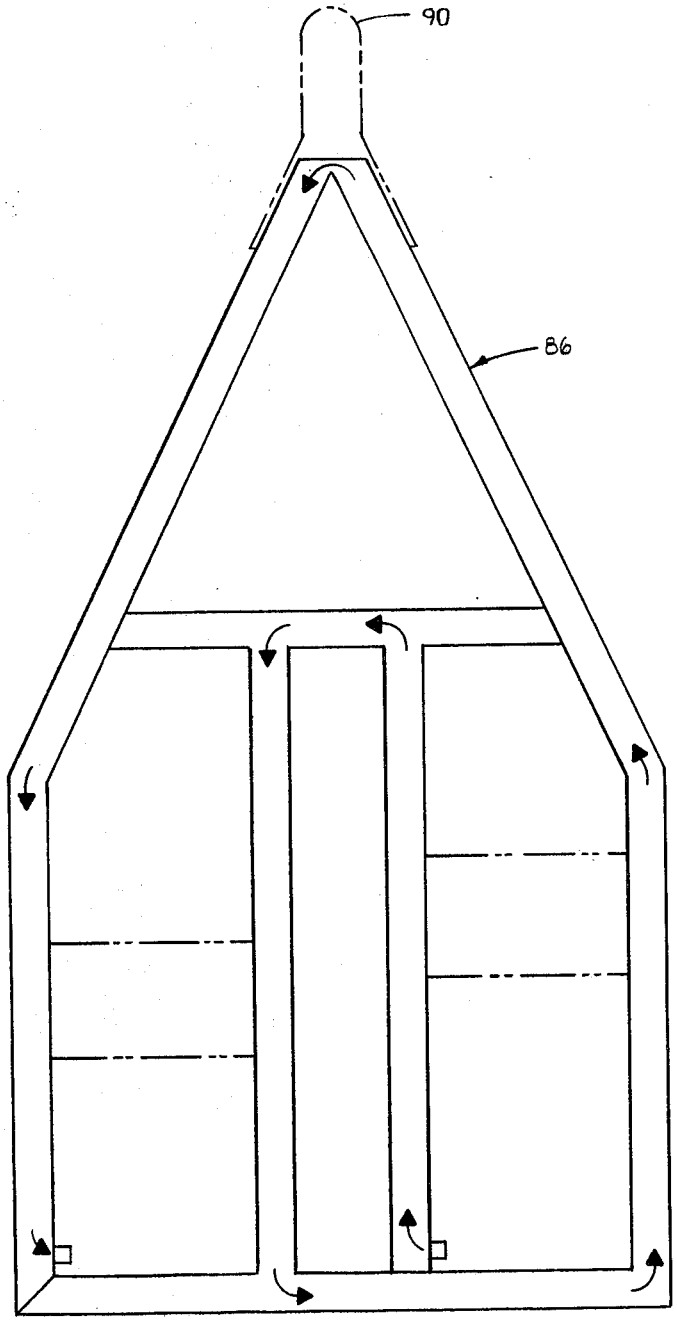
FIG. 8 is a top plan view of the trailer frame of the preferred embodiment of the wood splitter illustrating the position of the baffles and the hydraulic fluid flow path through the frame.

The hydraulic system for operating the splitter is shown in FIG. 4. It should be noted that most of the hydraulic connecting lines between the equipment are not shown to avoid obstructing a clear view of remainder of the apparatus whose positional arrangements and relationships are more important. A gasoline engine 122, which is started from a battery 124 by a starter switch 126, drives a hydraulic pump 128. The pump 128 draws hydraulic fluid 130 from a tank 132 through a filter 134 and pumps it under pressure through a series of interconnecting hydraulic lines 136 to actuate the cylinders 64 and 76. The high pressure line 138 and return line 140 are connected to a control valve 142. The control valve is a commonly available type of four-way valve with an intermediate neutral position. The position of a valve actuating arm 144, having its position controlled in turn by a spring loaded foot lever 146 and linkage 148, determines whether the valve is full or partially open in either mode or is in the neutral position. An over pressure relief valve 150 is provided between the high pressure line 138 and the return line 140. The return line 140 discharges the hydraulic fluid into the interior of the trailer horizontal framework 86. The framework 86 is liquid tight and baffled to provide an elongated path, as shown in FIG. 8, for the hydraulic fluid to pass through and become cooled before it is returned to the tank 130. A sequence valve 152 is provided in the section of the cylinder extension supply line 154 which leads to the lift cylinder 64. The valve is a type of commonly available valve which does not allow the passage of fluid to the lift cylinder until a certain pressure level is reached. To illustrate the operation of one such valve, referring to FIG. 4, a spring biased piston 156 blocks flow through the valve 152 until a counter-balancing pressure through a sensing line 158 connected to the valve inlet 160 is achieved to align the piston permitting flow through the valve. A check valve 162 in a bypass line permits unrestricted flow through the valve 152 in the opposite direction. A holding valve 164 of a type commonly available is connected in the section of the cylinder extension supply line 154 which leads to the blade cylinder 76. The holding valve 164 operates in a manner that is analogous to the sequence valve with the exception that the sensing line 166 is connected to the cylinder retraction supply line 168 and the bias selected so that the valve permits fluid passage from the cylinder 76 only when the retraction supply line is connected to the high pressure line 138 and a counter balancing pressure is achieved. A limit valve 170 is actuated by a spring loaded contact arm 172 which is contacted by the rear blade support plate 42 when the blade cylinder 76 is in its retracted position raising the blade 22. The limit valve 170, when the contact arm is depressed, permits fluid from the retraction supply line 168 to flow into the return line 140.

In preparing to split wood, the column 28 is raised to the upright position. To do this the engine 122 is started to operate the pump. The foot lever 146 is depressed from its normal up, or retracted position, through the neutral position to the extend position, as shown in FIG. 4. The fluid then causes the blade cylinder 76 to extend full stroke until the blade spacer plate 46 contacts the spacer bar 32 stopping the downward travel of the blade. This will cause the relatively low pressure in the extension supply line 154 to rise and actuate the sequence valve whereupon the lift cylinder begins to extend. This causes the lever arm 52 to contact crossbar 120 causing the column 28 to be lifted to almost its completely upright position. From this position the column 28 can be easily pulled manually to its final position and the locking pin 116 inserted in hole 118 to secure it in position. The foot lever is then released and the blade and lift cylinders 76 and 64 retract automatically and the machine is ready for splitting wood.

To split wood, a section of wood 26 is placed in a vertical position over the log lifter 60 and beneath the edge 24 of the blade 22. In this preferred vertical position of the wood splitter the log is easy to turn and otherwise manipulate as compared with a log which is lying on its side. The foot lever 146 is then depressed and the blade descends toward the top of the log at a rate determined by the distance the foot lever 146 is depressed. The foot lever is allowed to rise to a mid-position to stop the blade's descent if desired. When the blade edge 24 contacts the top of the log the pressure in the extension supply line 154 will begin to rise. If it is a small section of wood or very easily split wood, the wood may then split and the foot lever is released raising the blade 22 until the limit valve 170 is contacted stopping the blade's upward travel. Typically the wood does not split with such a light splitting force and the fluid pressure builds up until the sequence valve is actuated. This causes the lift cylinder 64 to actuate and raise the log lifter 60 to forcefully push the log 26 into the blade 22 causing it, normally, to be split. If the log does not split fully in two pieces, the initial split, resulting in a decrease in resistance to the blade, will cause the fluid pressure to drop and the sequence valve to close. The blade will then lower further while the log lifter 60 returns to its position flush with the deck 106. Upon encountering blade resistance the lifter 60 again actuates splitting the log or starting further successive blade lowering cycles until the log is split. Typically the log will split on the first such cycle. During the portion of the splitting cycle when the log lifter is being raised, the holding valve works to resist the tendency of the larger lift cylinder to overpower and reverse the direction of the smaller blade cylinder. At the same time the log tends to cause the blade assembly to twist clockwise, as viewed from the side as in FIG. 2. This twisting causes the blade to bind upon the hardened steel tracks 38. This binding effect further resists the tendency of the blade to move upward under the force of the lifter cylinder. This binding effect also reduces the load that the blade cylinder and holding valve must withstand.

If the foot lever is held down after a split is made, the blade and log lifter will make their closest approach, as shown in FIG. 1, and the relief valve 150 will open to prevent any damage.

After the split is made the foot lever may be released to permit the lifter to retract and the blade to raise fully. If the same log is to be split again in another place, or another log which is shorter than the distance between the fully retracted blade and deck, the foot lever may be manipulated to retract the blade only partially. This flexibility greatly increases the speed of operation where sequential splitting is to be done.

The lifter retracts fully each time the foot lever is positioned to retract the cylinders. The lack of resistance to its retraction, as compared to the weight the smaller blade cylinder must lift to retract, assures that the lifter cylinder retracts easily and quickly once the sequence valve closes after a split is made, or the foot lever is moved to the retract position.

The foot lever permits the hands of the operator to remain free to manipulate the wood being split.

With the deck 106 at a convenient above-ground level, the operator does not have to bend over to place logs in position for splitting or retrieve the split pieces. This eliminates 75 percent of the bending, squatting, and struggling that accompanies normal wood splitting procedures.

Since the operating fluid is relatively incompressible at normal operating pressures, the blade and lever do not suddenly snap towards each other once a log splits, and the stroke may be limited by releasing the foot lever. This allows the operator to hold the wood with his or her hands, if necessary, below the blade to position it with relative safety. This also avoids the split pieces of wood being hurled outward endangering the operator and others nearby. The mechanical limitation on the travel of blade and lifter towards each other provides an added degree of safety.

To lower the column for travel, the foot lever is depressed to extend the cylinders fully. The pump is then stopped and the locking pin 116 pulled to release the column and the column is allowed to lower by the force of gravity with the speed of descent controlled by the foot lever.

With a wood splitter of the above configuration having the following specifications:

Lift cylinder diameter: 4 inches
Blade cylinder diameter: 2 inches
Engine: 16 h.p. gasoline
Pump: 9GPM at 1750 PSI at 2400 RPM
Working pressure: 1500 PSI
Sequence valve actuation: 1000 PSI
Holding valve actuation: 250 PSI
Maximum log length: 27 inches
Minimum log length: 12 inches approx.
Blade travel: 18 inches
Log lifter travel: 3⅝ inches
Closest approach of blade and log lifter: 5 inches the following results were obtained:

Splits per minute: 20 approx. (on same piece of wood)
Splitting force: 25 tons
Blade downstroke time: 2 sec. (full stroke)
Blade return time: 1½ sec. (full return)
Lifter up stroke: 3 sec.
Lifter return stroke: 3 sec.
Full power splitting time: 1 to 3 sec.
Column lift and lower time: 6 to 12 sec.

An Embodiment Which uses a Threaded Shaft to Actuate the Blade

Figure 9:
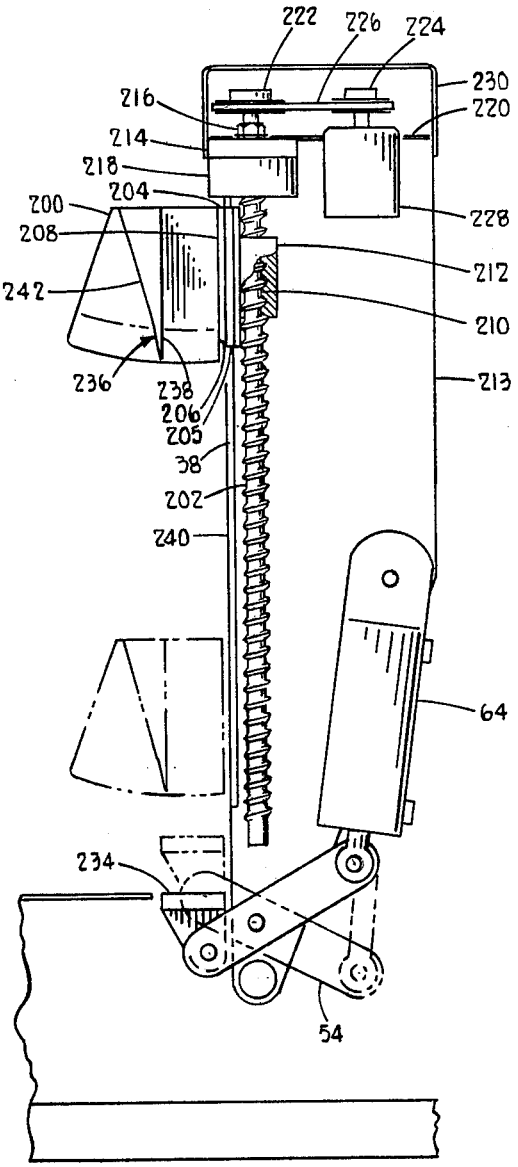
FIG. 9 is a partial side elevation, similar to FIG. 2, of an embodiment of the wood splitter using a threaded shaft to move the blade.
Figure 10:
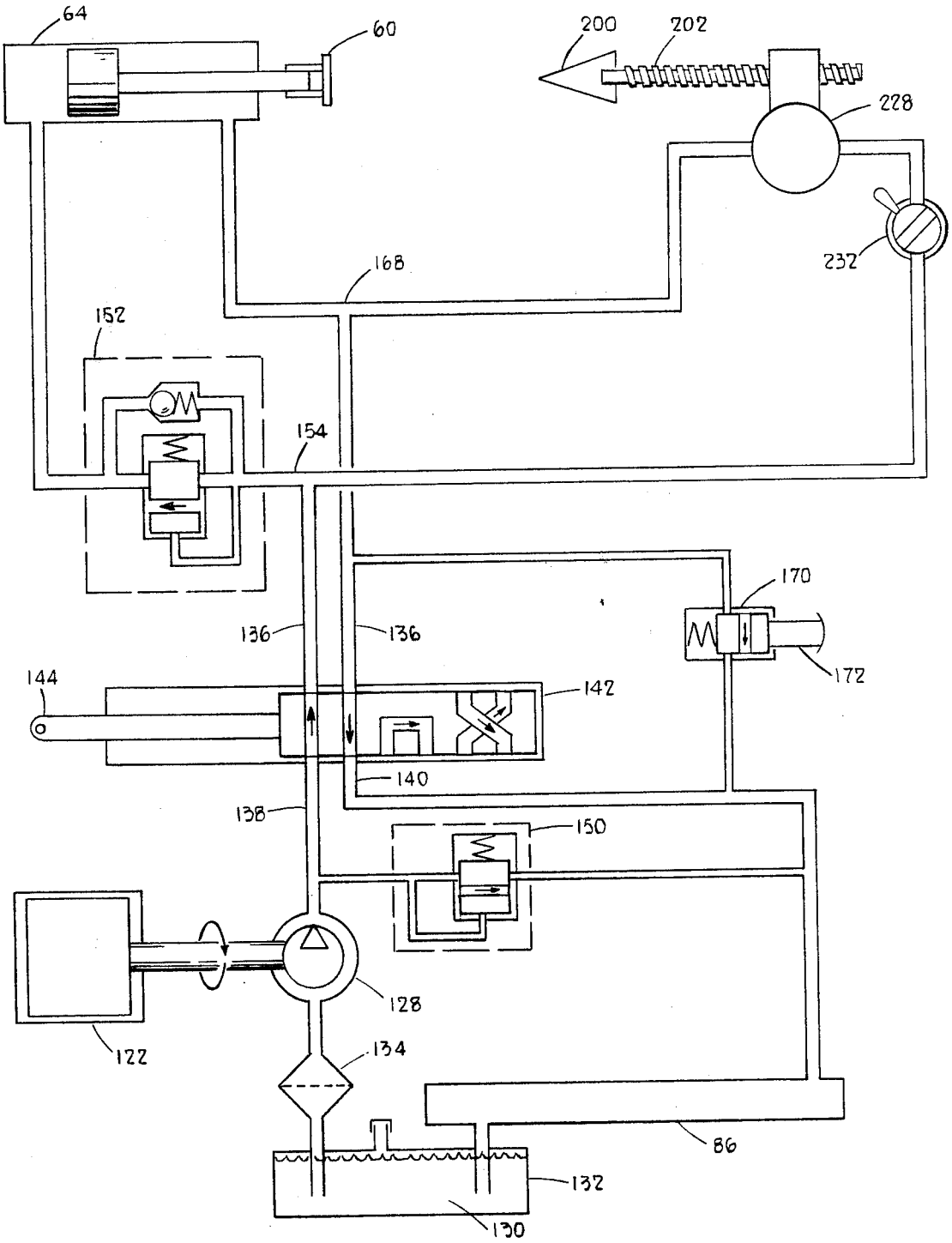
FIG. 10 is a schematic of the hydraulic system for the embodiment of the wood splitter shown in FIG. 9.

Another embodiment is illustrated in FIGS. 9 and 10. In this embodiment the blade 200 is mounted on a threaded shaft 202. The blade support 204, instead of consisting of three separate pieces is constructed from a single piece of material having grooves 205 which engage the track 38. The lower front edge 206 of the support 204 is beveled as in the preferred embodiment. On this embodiment the clockwise rotation and binding of the blade on the tracks is not required so the front of the blade support 208 extends the full width of the support for its full length. The threaded shaft 202 passes through a hole 210 in the rear section 212 of the support 204. The hole 210 has internal threads which mate with these of the threaded shaft. The shaft is longitudinally aligned with the column 213 and supported from its upper end. A backup plate 214, nut 216 and thrust bearing 218 provide the connection to a top plate 220 on the column 213. The shaft is free to turn and is connected by sprockets 222 and 224 and chain 226 to a hydraulic motor 228. The upper end of the column is enclosed with a safety cover screen 230. The hydraulic system for this embodiment is the same as in the preferred embodiment except the blade cylinder is replaced with the hydraulic motor 228 and the holding valve is eliminated. Also a shut-off valve 232 is inserted in the extension supply line 154 leading to the hydraulic motor. This valve permits the blade action to be stopped when the column 213 is raised to the upright position and lowered. Other than the manual opening and closing of this valve 232, the method of raising and lowering the column is the same as described above. Also in this embodiment the pressure level at which the sequence valve 152 actuates is lower. For example, 400 psi as compared to 1000 psi for a model of the preferred embodiment.

In operation this embodiment operates similar to the preferred embodiment. When a log is placed beneath the blade 200 and above the log lifter 234, the control valve 142 is actuated and the hydraulic motor 228 causes the threaded shaft 202 to rotate and lower the blade 200. Once the blade contacts the top of a piece of wood the pressure in the extension supply line 154 rises and the sequence valve 152 actuates to start the log lifter cylinder 64 and effectuate the splitting as previously described above.

The lower end of the column 213 varies from that shown in the preferred embodiment to illustrate another acceptable configuration.

The blade 200 differs from that shown on the preferred embodiment in that it has two side blades which extend from opposite sides of the main blade 200. This results in an ability to split a log into four sections in a single pass of the blade. The inner side 238 of the blade is parallel to the face 240 of the column 213 to avoid wedging a section of wood against the column. The opposite surface 242 slopes outward.

Other Embodiments

Figure 6:
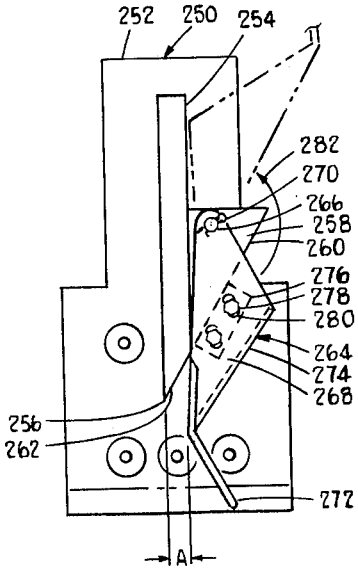
FIG. 6 is a front elevation view of the preferred embodiment of the shake splitting blade.
Figure 7:
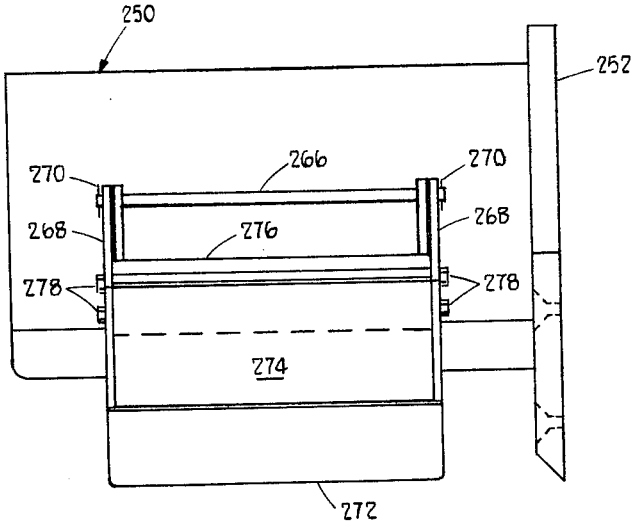
FIG. 7 is a side elevation view of the preferred embodiment of the shake splitting blade.

FIGS. 6 and 7 illustrate a shake splitting blade 250 which may be utilized with either of the above described embodiments. It is shown attached to a front support plate 252 which is the same as that described on the preferred embodiment. The shake blade 250 consists of a rectangular plate 254 attached at a right angle to the front support plate, having its lower edge shaped to form a sharp cutting edge 256, as by beveling it. An extension of the edge 256 on one side is formed, such as by a side plate 258 having a triangular cross-section and shorter in length than the plate 254 attached to the side of the plate 254. The sloping side 260 of the side plate 258 serves to form the extension of the beveled surface 262. A guide member 264 is pivotally attached such as by rod 266 through its end panels 268 to the side plate 258 and secured in place as by coffer pins 270. The two end panels are connected together by a guide panel 272 and reinforcing panel 274 having a V-shaped cross-section. It is preferred that the blade 250 be constructed from steel and that the guide 264 be of aluminum or some other non-magnetic material. A releasable retainer, such as a magnet 276, is adjustably attached as by bolts 278 through slots 280 to the guide.

In use as a blade for splitting shakes, the position of the magnet 276 is adjusted so that the distance A from the blade edge 256 to the guide 264 corresponds to the desired shake thickness. Generally this distance is ½ to 1½ inches. The bolt of shake wood is then positioned below the blade and the blade 250 is lowered to just above the bolt. The bolt is then moved over as necessary until it contacts the guide. The magnet 276 which may be of the permanent or electromagnetic type is preferably of a strength so that it will take in the range of 50 to 300 pounds of horizontal force before the guide swings away in the direction of the arrow 282. A 200 pound holding force is favored. Once the shake bolt is aligned the downward stroke of the blade 250 is continued to split off a shake. The guide 264 swings up out of the way due to contact with the shake as the blade passes through the shake bolt to allow the shake to split off and to fall to the side. The weight of the guide and the magnet cause the guide to return to its original position. The bolt is then moved over against the guide after the blade is raised to be prepared for the splitting off of another shake in rapid sequence. The preferred V-shape to the guide panel 272 helps to position the shake bolt accurately and rapidly. This blade 250 works particularly well with the above described wood splitters where the blade position may be easily controlled in its rate and height of movement for rapid sequential splitting.

Other blade configurations may be used with the wood splitter, but those illustrated are preferred.

It is not necessary that the blade cylinder 76 and lift cylinder 64 be of different sizes for successful operation, but it is preferred that they are.

I claim:

1. A wood splitter comprising:

a. a column having a first and second end;

b. a blade slidably attached to the column having its edge directed toward the second end of the column;

c. a pusher member attached to the second end of the column having a portion thereof movable along the column toward the blade edge;

d. means for moving the blade directly toward the pusher to contact one end of a piece of wood placed between the blade and the pusher while the opposite end of the piece of wood contacts the pusher member; and e. means for forcefully moving the pusher member so that the portion that moves toward the blade causes the wood to move against the blade and split.

2. A wood splitter, as claimed in claim 1, comprising, in addition, means for controlling the blade moving means and the pusher member moving means so that the blade first moves toward the pusher member to securely clamp a piece of wood between the blade and the pusher member and then the pusher member moves toward the blade to effectuate the splitting of the wood.

3. A wood splitter, as claimed in claim 1, wherein the pusher member comprises a lever pivotally attached to the column.

4. A wood splitter, as claimed in claim 3, wherein the means for moving the pusher lever comprises a hydraulic cylinder attached between the column and the lever and a means for supplying hydraulic fluid under pressure to actuate the cylinder.

5. A wood splitter, as claimed in claim 4 wherein the blade has a threaded hole passing through it and wherein the blade moving means comprises a threaded shaft, longitudinally aligned with the column and rotatably attached to the column, passing through the hole in the blade and having its threads engaging the threads in the hole in the blade and means for rotating the shaft to cause the blade to move along the column.

6. A wood splitter, as claimed in claim 4 wherein the blade moving means comprises a second hydraulic cylinder attached between the column and the blade and means for supplying hydraulic fluid under pressure to actuate the cylinder.

7. A wood splitter, as claimed in claim 6, comprising, in addition, means for controlling the hydraulic fluid supplied to the pusher cylinder and the blade cylinder so that the blade is first forced against the piece of wood to securely clamp it between the blade and the pusher lever and then the pusher lever is forcefully moved to effectuate the splitting of the wood.

8. A wood splitter, as claimed in claim 7, wherein the hydraulic fluid control means comprises a sequence valve.

9. A wood splitter, as claimed in claim 6, comprising, in addition, means for resisting the tendency of the blade to reverse directions during the splitting operation and be forced away from the pushing lever toward the first end of the column by the force of the pushing lever.

10. A wood splitter, as claimed in claim 9, where the blade reversal resistance means comprises a holding valve in the blade hydraulic supply means which allows the fluid traveling to the blade cylinder to enter but not leave the cylinder during the splitting operation.

11. A wood splitter, as claimed in claim 10, comprising, in addition, a sequence valve associated with both hydraulic fluid supply means for controlling the hydraulic fluid supplied to the pusher cylinder the blade cylinder so that the blade is first forced against the piece of wood to securely clamp it between the blade and the pusher lever and then the pusher lever is forcefully moved to effectuate the splitting of the wood.

12. A wood splitter, as claimed in claim 12, wherein the column has a pair of tracks running longitudinally along its length and the blade has a pair of elongated grooves which engage the tracks to slidably attach the blade to the column, the grooves being offset laterally from the edge of the blade where it contacts the piece of wood so that a twisting of the blade on the track occurs to bind the blade in position on the tracks and further resist the tendency of the blade to reverse directions during the splitting operation.

13. A wood splitter, as claimed in claim 13, wherein the column is positionable in an upright position and comprising, in addition, a substantially horizontal planar working surface adjacent the column having an opening in the surface permitting the portion of the pusher lever which is movable toward the blade to project above the surface when effectuating the splitting.

14. A wood splitter, as claimed in claim 13, comprising in addition a trailer structure and wherein the column and planar working surface are mounted on the trailer structure to permit travel to a convenient location where the wood splitting operation will occur.

15. A wood splitter, as claimed in claim 6, wherein the column has a pair of tracks running longitudinally along its length and the blade has a pair of elongated grooves which engage the tracks to slidably attach the blade to the column, the grooves being offset laterally from the edge of the blade where it contacts the piece of wood so that a twisting of the blade on the track occurs to bind the blade in position on the track and resist the tendency of the blade to reverse directions during the splitting operation.

16. A wood splitter, as claimed in claim 1, wherein the column is positionable in an upright position and comprising, in addition, a substantially horizontal planar working surface adjacent the column having an opening in the surface permitting the portion of the pusher member which is movable toward the blade to project above the surface when effectuating the splitting.

17. A wood splitter, as claimed in claim 16, comprising, in addition, a trailer structure and wherein the column and the planar working surface are mounted on the trailer structure to permit travel to a convenient location where the wood splitting operation will occur.

18. A wood splitter, as claimed in claim 17, wherein the pusher member comprises a lever pivotally attached to the column having a first and second end with its first end opposite the blade edge; wherein the column is pivotally attached to the trailer structure to permit the column to be placed in a lowered position for travel; and comprising, in addition, a cross member attached to the trailer structure adjacent the second end of the lever arm so that when the pusher member moving means is actuated to move the lever when the column is in the lowered position the column is raised.

* * * * *